United States Patent [19]

Axryd

[11] 4,021,962

[45] May 10, 1977

[54] DEVICE IN CONNECTION WITH GAMES OR TOYS

[76] Inventor: Helge A. W. Axryd, Cederbourgsgatan 8, 412 55 Goteborg, Sweden

[22] Filed: Dec. 11, 1975

[21] Appl. No.: 639,906

[30] Foreign Application Priority Data

Dec. 12, 1974 Sweden ..... 7415518

[52] U.S. Cl. ..... 46/202; 46/1 C; 46/206; 46/251

[51] Int. Cl.[2] ..... A63H 18/14

[58] Field of Search ..... 46/1 C, 202, 206, 251, 46/257, 259; 273/86 B, 86 E, 86 H

[56] References Cited

UNITED STATES PATENTS

| | | | |
|---|---|---|---|
| 3,473,805 | 10/1969 | Biller | 46/257 |
| 3,559,334 | 2/1971 | Beny et al. | 46/206 |

*Primary Examiner*—Louis G. Mancene
*Assistant Examiner*—Robert F. Cutting

[57] ABSTRACT

A toy comprising a track and an article movable along a predetermined path capable of reciprocable movement by means of a driving means provided with longitudinally interspaced projections to engage projecting carrier pins on the movable article to be propelled.

5 Claims, 3 Drawing Figures

DEVICE IN CONNECTION WITH GAMES OR TOYS

The present invention relates to a toy comprising at least one track along which an object preferably on wheels, e.g., a car, an animal or the like, is movable, and which is driven by means of a movable driving means capable of reciprocating movement of displacement along said track. The means is provided with longitudinally interspaced projections intended to cooperatively engage projecting carrier pins from the objects in question for their drive in connection with said movement of the driving means.

It is a principal object of the invention to provide a toy of the kind mentioned above, which includes means for an automatic reversal of the direction of movement of the objects at least at one point along the track. This desired condition arises especially when the track is not in the form of a closed circuit, although the invention can of course be utilized in connection with closed tracks without departing from its fundamental idea.

It is an additional object to provide a reversing device of the kind mentioned, which is of simple design, reliable in function, and moreover inexpensively manufactured.

These objects are attained by means of a device according to the invention, which includes a carrier pin in the form of a pawl-like device connected with the object in question or which can be attached to the same. The length from the point of attachment of said pawl-like device exceeds the distance from the point of attachment to the projection of the driving means for the formation of a unilaterally functioning slip lock. The engagement of the slip lock by means of a slight yielding force pressed against the driving means while the pin is movable relative to the object in question in the longitudinal direction of the driving means in order to reverse the direction, in which it is dragged and consequently also the direction of drive, the driving organ at least at one end of the travelling path of the object exhibiting a portion, which is located at a distance from the point of attachment of the carrier pin exceeding its length in order to make possible the transfer of the carrier pin from one of its locking positions to the other locking position and thereby obtain a reverse of the direction of drive.

Figure 1:
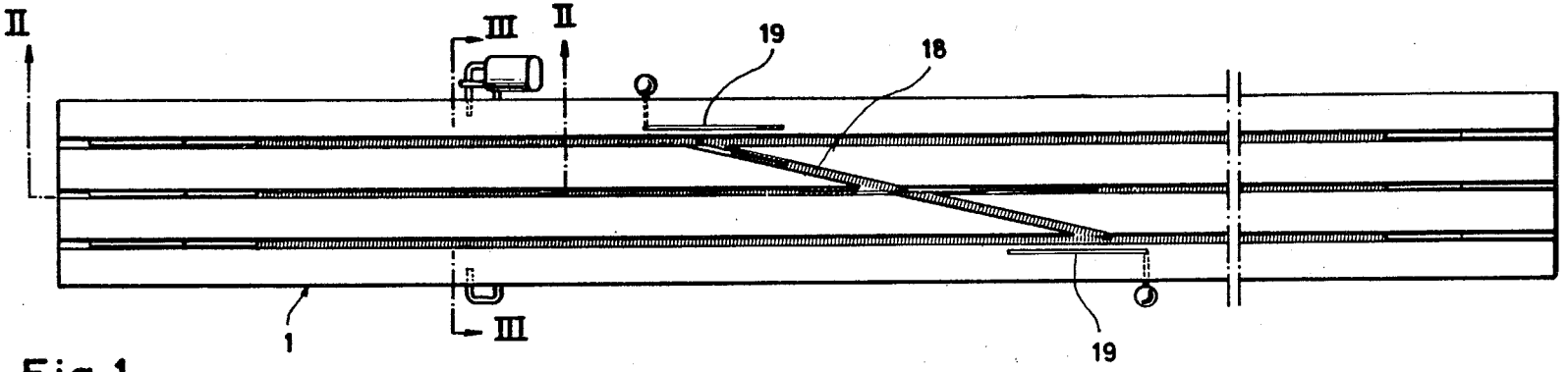
Figure 2:
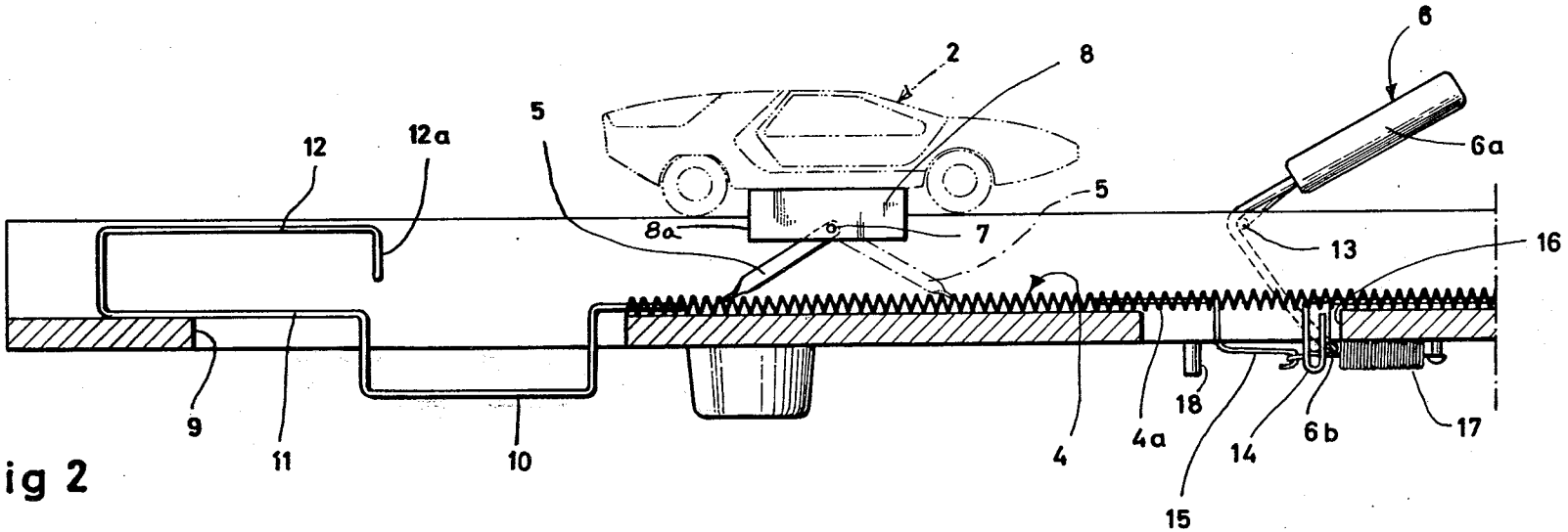
Figure 3:
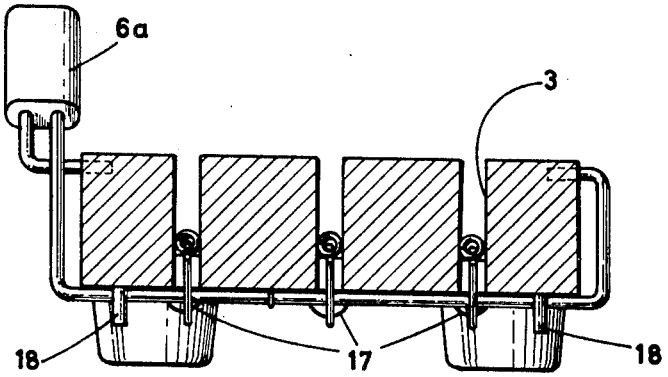

In the following an example of embodiment of the object of the invention will be described, reference being madeto the accompanying drawings, in which FIG. 1 is a top view of a track equipped with a device according to the invention, FIG. 2 on a enlarged scale shows a cross sectional view, the section being made along the line II—II of FIG. 1, i.e. showing one end portion of the track, in said FIG. 2 an object, which is movable along the track in this case having the shape of a car, having been included, and FIG. 3 is a cross sectional view along the line III—III of FIG. 1.

In the drawings a track of long extension is in its entirety indicated with 1, and a number of objects movable along the track in question with 2. These objects can by way of example be made and is shown in the drawing in the shape of a car, but other shapes as for example animals and people can of course be used. However, it is advantageous to provide these objects with wheels in order to reduce the friction against the upper side of the track as much as possible. Within the scope of the invention the track 1 can, of course, be given another design than the straight shape illustrated in the Figures. The track 1 is made in one piece in which a number of outwardly open grooves 3 are made, in the bottom of which a driving means 4 is resting, which substantially comprises a helically coiled wire, the coils of which form a number of projections interspaced along its length, and which in connection with the drive of the object 2 cooperates with a pawl-like carrier pin 5 fitted to the object. The driving means 4 is arranged by means of an operating arm 6 to be able to provide a comparatively rapid reciprocating movement. The carrier pin 5 forms a unilaterally working slip lock, i.e. a lock, which permits the movement of the driving means past it in one dirction, and which grips the driving means in connection with its movement in the reverse direction, the object 2 following the driving means in the last mentioned direction. The carrier pin 5 comprises an arm, which in its engaging end is shaped like a chisel, and in the opposite end is pivotable around an axis 7 on a body 8 fastened to the underside of the object, said body 8 being comparatively long and at the same time extending a distance down into the groove 3 thus being guided along the walls of the groove in connection with the movements of the object 2. The arm 5 rests as shown in the embodiment illustrated against the driving means by its own weight, but it is of course also possible to subject it to spring biasing in the direction towards the driving means. The end portion of the driving means illustrated in the FIG. 2 comprises a plain wire, which exhibits a bent portion 10, extending down through a slit 9 made in the bottom of the track, which portion to the left according to the FIG. 2 passes to a supporting portion 11 resting against the bottom of the groove. The supporting portion in its turn passes to an upwardly bent portion 12, the right end **12*a* of which according to the same figure together with the left end 8*a* of the body 8 in the FIG. 2 forms a cooperating stop dog. The operating bar 6 is designed as a double armed lever, pivotable round an horizontal shaft 13. One arm of the lever has a hand or finger grip 6*a* and the other arm 6*b* includes a portion, which bears against a double bent wire 14 extending downwards from the screw coiled wire 4*a*. The arm 6*b* is movable in connection with the movements of the operating bar 6. The wire 14 with which the operating bar is in driving connection extends further a distance along the driving means inside the coiled wire arrangement 4*a* and thus forms a guide for this wire, which impedes that it is lifted up from the bottom in connection with a movement in one direction. In order to prevent the driving means from being lifted up in connection with a movement in the other direction, a second wire 15 is threaded in the opposite direction, said second wire also extending down through an opening 16 made in the bottom of the groove near the first mentioned wire 14. A tension spring 17 is coupled to the downwards projecting portion of the wire 14, which tends to bring the wire 4 to the right according to the Figure, and consequently pivot the operating bar 6 in counter-clockwise direction according to the same Figure to the position illustrated in the drawing. This means that the driving means 4 after being pressed down by the operating bar 6 tends to be displaced backwards in direction to the right. A rapid reciprocating movement of the driving means can thereby be provided by light strokes against the top side of the operating bar 6. A stop dog limiting the movement of the operating bar 6 is indicated with 18. From the FIG. 3** the design of the operating bar is clearly evident, and for this reason it need not be further described.

When the carrier pin 5 is in the position marked with dashed and dotted lines in the FIG. 2, the object displaces itself in activated condition to the kit driven by the driving means 4 until it reaches the portion 10 of the driving means, which is located sufficiently below the arm 5 that it is no longer in engagement. In this position the arm 5 will be in a suspended vertically downward position until by cooperation between the stop dog 12*a* and the counter stop dog 8*a* the object 2 will have received a push to the right, so that the arm again slides up on the drive-active portion of the driving means 4. Hereby the arm 5 occupies the position marked with continuous lines, the object 2 now instead being driven to the right. The track illustrated in the drawings exhibits corresponding portions at both ends, which means that the objects can move backwards and forwards an unlimited number of times, i.e. as long as the driving organ is actuated by means of the operating bar 6. In the example of embodiment illustrated all driving means are coupled to one and the same operating bar, but it is of course also within the scope of the invention to arrange a separate operating bar for each driving means in order to obtain an individual drive. It is of course also within the scope of the invention to exchange the operating bar 6 against a driving motor or the like. In the FIG. 1 a feeding means extending between the two outermost located grooves is indicated with 18, which in principle is shaped like the other feeding means, and which is coupled together with one of the two outer feeding means and is lowered in a groove, which extends diagonally over the track from one outer groove to the other. On account of the feeding means 18 being coupled together wth the other feeding means, a reciprocating movement is provided. A guiding means arranged in connection with each one of the two outer grooves is indicated with 19, and it serves to guide the objects in question in a pivoted position along the feeding means 18 from one outer groove to the other.

The invention is not limited to the embodiment described above and illustrated in the drawings by way of example only, but can be varied as to its details within the scope of the following claims without departing from the fundamental idea of the invention. It is for example possible to design the pawl in a different manner than the one illustrated in the drawings. By way of example this can comprise a flexible means fastened directly to the body 8.

What I claim is:

1. A toy including a grooved track and an object to be moved on the surface thereupon comprising:

a. coiled spring driving means located in said track groove said spring having spaces between coils and a bent wire at at least one of its ends, b. carrier pins pivotally mounted about said object to bear upon and engage said coils, with the distance between said pivotal mounting and said spring being less than the length of the carrier pin thereby forming a slip-locking means, c. said groove having at least one portion at an end of said coiled spring where the distance between the groove and the pivotal mounting exceeds the length of said carrier pin thereby allowing for a change in the slip-lock position, d. means for imparting axial movement to said coil spring driving means.

2. The toy of claim 1 in which part of said bent wire is vertically disposed in the axial path of the object and cooperating with a part of said object to form a stop dog.

3. the toy of claim 1 which comprises a projecting guide mounted under said object, said guide being mated with said groove.

4. The toy of claim 3 in which said carrier pin is mounted on said projecting guide.

5. The toy of claim 3 in which said projecting guide forms a cooperative element for a stop dog.

* * * * *